US007389660B2

(12) United States Patent
Ebling

(10) Patent No.: US 7,389,660 B2
(45) Date of Patent: Jun. 24, 2008

(54) DEADBOLT CLIP/RETAINER FOR INTERIOR DOUBLE CYLINDER SETS

(75) Inventor: Keith J. Ebling, Schuylkill Haven, PA (US)

(73) Assignee: Newfrey LLC, Newark, DE (US)

( * ) Notice: Subject to any disclaimer, the term of this patent is extended or adjusted under 35 U.S.C. 154(b) by 153 days.

(21) Appl. No.: 11/499,305

(22) Filed: Aug. 4, 2006

(65) Prior Publication Data

US 2008/0028809 A1 Feb. 7, 2008

(51) Int. Cl.
*E05B 15/02* (2006.01)

(52) U.S. Cl. ..... 70/370; 70/450; 70/451; 70/452; 70/DIG. 57; 70/DIG. 60

(58) Field of Classification Search ..... 70/370, 70/371, 381, 448–452, 466, DIG. 60, DIG. 57, 70/DIG. 56, DIG. 43, DIG. 63; 292/356, 292/357

See application file for complete search history.

(56) References Cited

U.S. PATENT DOCUMENTS

| | | | | | |
|---|---|---|---|---|---|
| 1,461,756 | A | * | 7/1923 | Croning | 70/452 |
| 1,506,051 | A | * | 8/1924 | Devereaux | 70/370 |
| 3,455,129 | A | * | 7/1969 | Forbes et al. | 70/370 |
| 3,745,795 | A | * | 7/1973 | Sanders | 70/451 |
| 3,992,908 | A | * | 11/1976 | Crepinsek | 70/370 |
| 4,073,172 | A | | 2/1978 | Schlage | |
| 4,490,998 | A | | 1/1985 | Wellekens | |
| 4,593,546 | A | * | 6/1986 | Allen | 70/380 |
| 4,633,690 | A | * | 1/1987 | Foshee | 70/451 |
| 5,024,070 | A | | 6/1991 | Toledo | |
| 5,351,513 | A | | 10/1994 | Ellis | |
| 5,722,273 | A | | 3/1998 | Lin et al. | |
| 5,873,272 | A | * | 2/1999 | Thompson | 70/100 |
| 5,881,590 | A | | 3/1999 | Small | |
| 6,230,528 | B1 | | 5/2001 | Don et al. | |
| 6,484,542 | B1 | | 11/2002 | Klingler | |
| 6,523,379 | B2 | | 2/2003 | Teskey | |
| 6,601,417 | B2 | | 8/2003 | Cowper | |

* cited by examiner

*Primary Examiner*—Lloyd A Gall
(74) *Attorney, Agent, or Firm*—Richard J. Veltman; John D. DelPonti

(57) ABSTRACT

An escutcheon assembly for a deadbolt lock on a door, and particularly for the interior side of a double cylinder deadbolt lock. The escutcheon assembly generally comprises a tapered collar carried on the deadbolt cylinder (and retained by a flange on the cylinder), plus a decorative face plate substantially covering the cylinder and secured to the collar by a novel clip and set screw mechanism. The collar has an annular groove defining opposing walls, the outermost wall (away from the door) having an inwardly angled surface to taper the groove. The decorative face plate has a clip protruding interiorly therein to a distal end that conforms to the tapered annular groove in the collar (for engagement therewith). A set screw is threaded into the frame opposite the clip and protrudes inward behind the aperture to a distal end that likewise conforms to the tapered annular groove in the collar (for engagement therewith). Insertion of the face plate clip into the groove of the collar and tightening of the opposed set screw into the collar self-centers and affixes the decorative face plate over the cylinder flush against the door with a secure tamper-proof attachment, and the decorative face plate may take virtually any outward shape (rectangular, square, etc.) making it much easier to match inside and outside face plates.

15 Claims, 4 Drawing Sheets

DEADBOLT CLIP/RETAINER FOR INTERIOR DOUBLE CYLINDER SETS

BACKGROUND OF THE INVENTION

1. Field of the Invention

The present invention relates to double cylinder deadbolt locks and, more particularly, to an escutcheon assembly that allows virtually any shape of escutcheon to be secured to the inside cylinder of a double-cylinder deadbolt lock to match the outside face plate.

2. Description of the Background

A single-cylinder deadbolt lock typically provides a keyed-cylinder on the exterior of the door and a thumb-turn on the interior. Single-cylinder deadbolt locks can be easily opened from inside without a key, and manufacturers are unconcerned with tampering from the inside. Consequently, the interior and exterior face plates are typically attached by inserting screws through the interior face plate into threaded receptacles protruding rearwardly from the exterior face plate. This makes it impossible to remove the lock from the outside but quite easy from the inside. On the other hand, a double-cylinder deadbolt provides a keyed cylinder on both the interior/exterior. Thus, a key is needed even from the inside to unlock a double-cylinder deadbolt. In this case manufacturers are concerned with tampering from both sides, and no screws are accessible from either the interior or exterior face plates.

FIG. 1 illustrates a typical double-cylinder deadbolt lock assembly in which an outside cylinder 2 is seated in an outside cylinder housing 3. The outside cylinder 2 engages a deadbolt 5 that is anchored inside the door. On the inside of the door a removable-core inside cylinder 7 is inserted into an inside cylinder housing 6. The inside cylinder 7 is attached to the outside cylinder 2 by a pair of screws 8. A face plate 9 is seated atop the inside cylinder 7 to cover the screws 8, and the removable core 10 is inserted into the inside cylinder 7 and thereby captures the face plate 9 against the inside cylinder 7. A problem with the foregoing arrangement is that it does not allow for any interchangeability of face plates. Property owners often prefer square or other odd-shaped decorative face plates (other than round), and this is difficult with the illustrated configuration because the round cylinders must be seated in round face plates. There have been previous attempts to add decorative face plates or "escutcheons". For example, U.S. Pat. No. 5,351,513 to Ellis issued Oct. 4, 1994 shows a double cylinder deadbolt provided with a cylinder housing collar 20 that fits around the inside cylinder. An escutcheon 80 is screwed onto collar 20 and substantially covers the lock, leaving the keyway accessible. Even here, due to the screw-attachment of the escutcheon 80 onto collar 20 both of these components are round.

It would be greatly advantageous to provide a secure mechanism for attachment of an escutcheon of any shape to a deadbolt lock, and particularly for attachment of an escutcheon to the interior side of a double-cylinder deadbolt lock to facilitate a match to the exterior face plate, no matter the shape. The new escutcheon assembly and attachment mechanism should be straightforward in manufacture and use.

SUMMARY OF THE INVENTION

It is, therefore, the primary object of the present invention to provide an apparatus for secure attachment of an escutcheon of virtually any shape to a deadbolt lock.

It is another object to provide an escutcheon assembly that allows virtually any shape of escutcheon to be secured to the inside cylinder of a double-cylinder deadbolt lock to match the outside face plate.

It is still another object to provide an escutcheon assembly as described above that is straightforward in manufacture and use.

In accordance with the foregoing objects, the present invention is an escutcheon assembly for a deadbolt lock on a door, and especially for the interior side of a double cylinder deadbolt lock of a type having a deadbolt in cooperation with a keyed interior cylinder having an annular peripheral flange. The escutcheon assembly generally comprises a tapered collar carried on the cylinder behind the flange, and a decorative face plate substantially covering the cylinder and secured to the collar by a novel clip and set screw mechanism. The collar has a central aperture adapted for insertion onto the cylinder (behind and abutting the flange), and the collar is formed with an annular groove defining opposing walls, the outermost wall (away from the door) having an inwardly angled surface to taper the groove. The decorative face plate comprises a frame with recessed interior and a central aperture through the frame for exposing a frontal portion of the cylinder. A clip is attached to a hub in the frame and protrudes inward behind the aperture to a distal end that conforms to the tapered annular groove in the collar (for engagement therewith). A set screw is threaded into the frame opposite the clip and protrudes inward behind the aperture to a distal end that likewise conforms to the tapered annular groove in the collar (for engagement therewith). With this configuration, insertion of the face plate clip into the groove of the collar and tightening of the opposed set screw into the collar affixes the decorative face plate over said cylinder flush against said door. The escutcheon assembly offers a secure tamper-proof attachment, and the decorative face plate may take virtually any outward shape (rectangular, square, etc.), thereby making it much easier to match an inside face plate to the outside face plate.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

The present invention is an escutcheon assembly that allows virtually any shape of escutcheon (face plate) to be secured to the cylinder of a deadbolt lock, and particularly to the inside cylinder of a double-cylinder deadbolt lock to provide flexibility in matching inside and outside decorative face plates.

Figure 1:
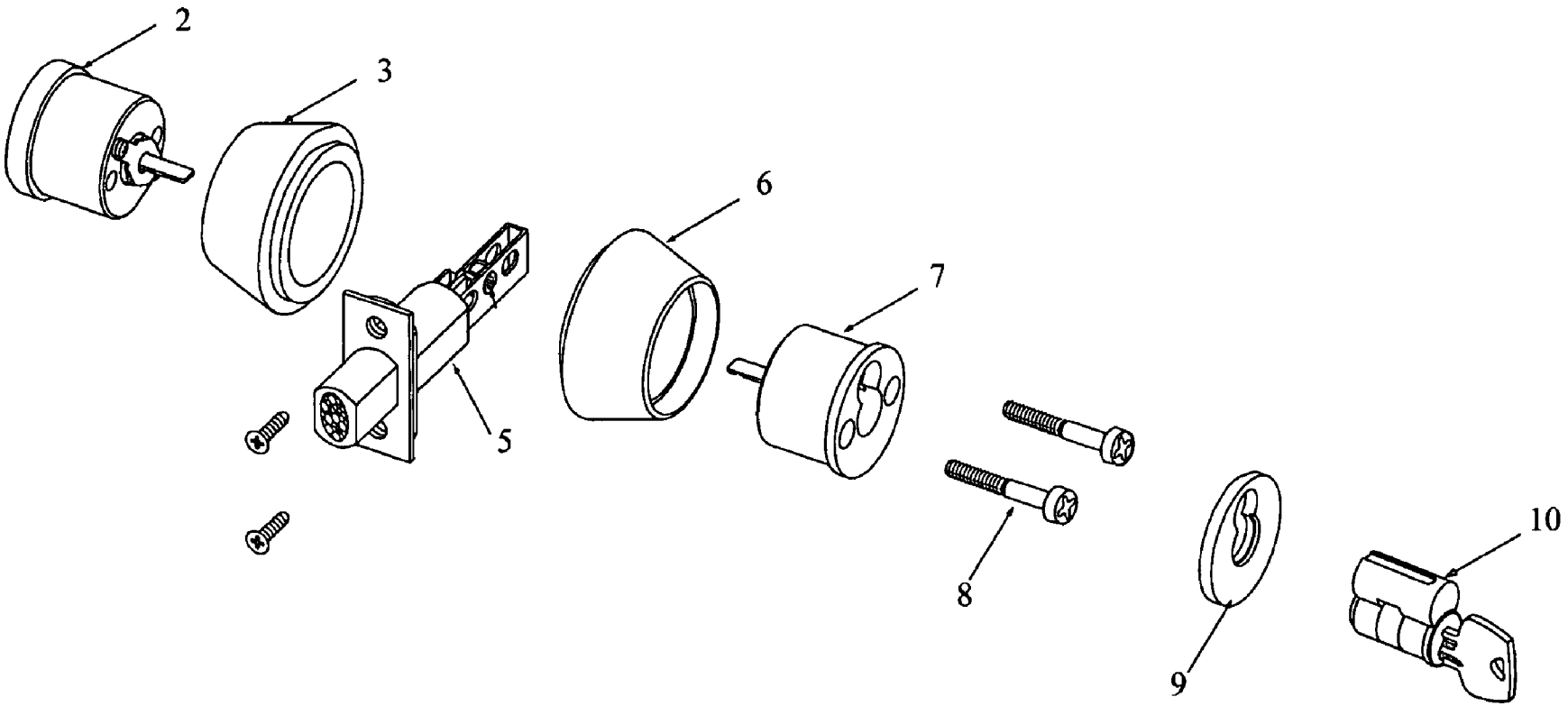
FIG. 1 (Prior Art)
FIG. 1 illustrates a prior art double-cylinder deadbolt lock assembly.
Figure 2:
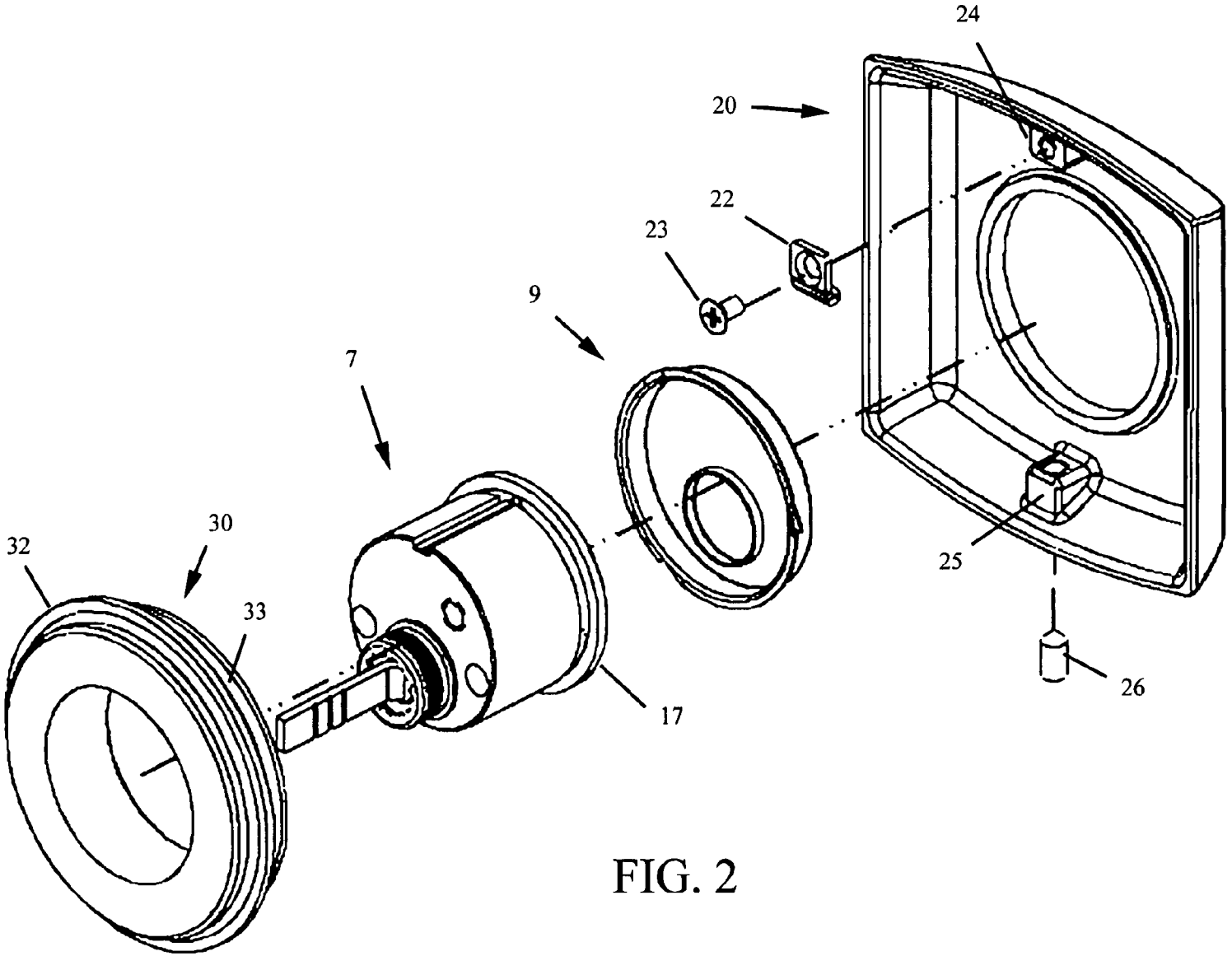
FIG. 2 is a perspective exploded view of the escutcheon assembly including decorative face plate 20 and tapered collar 30 according to the present invention.

FIG. 2 is a perspective exploded view of the escutcheon assembly according to the present invention. As in conventional double-cylinder deadbolt locks, the present assembly builds upon a standard keyed cylinder such as interior cylinder 7 as in FIG. 1, and face plate 9. The escutcheon assembly generally comprises a tapered collar 30 and decorative face plate 20 secured to the tapered collar 30 in a novel non-threaded manner. More specifically, the interior cylinder 7 is formed with an annular flange 17 and the tapered collar 30 is dimensioned for insertion onto the interior cylinder 7 behind the flange 17, thereby being sandwiched against the door (not shown). The standard face plate 9 is inserted onto the cylinder 7, and the decorative face plate 20 is positioned against the door to cover and enclose all of the foregoing components. The decorative face plate 20 includes a frame with a recessed interior and a central aperture and attaches to the tapered collar 30 without threads by an overhead clip 22 and opposing set screw 26. The tapered collar 30 is formed with an annular lip 32 adjacent a groove 33. Thus, to assemble, the decorative face plate 20 is positioned against the door so as to cover and enclose the cylinder 7 and face plate 9 with overhead clip 22 seated overtop the lip 32 of tapered collar 30. The clip 22 supports the decorative face plate 20 against the door and brings the set screw 26 into alignment with the groove 33 of tapered collar 30. The set screw 26 is then tightened and the contour of groove 33 forces the decorative face plate 20 against the door to ensure a secure mount. The combined set screw 26 and clip 22 provide a leveraged and steadfast attachment of the decorative face plate 20. Moreover, since the clip 22 and set screw 26 can be mounted virtually anywhere within the confines of the decorative face plate 20 the face plate 20 can assume virtually any shape as a matter of design choice.

Figure 3:
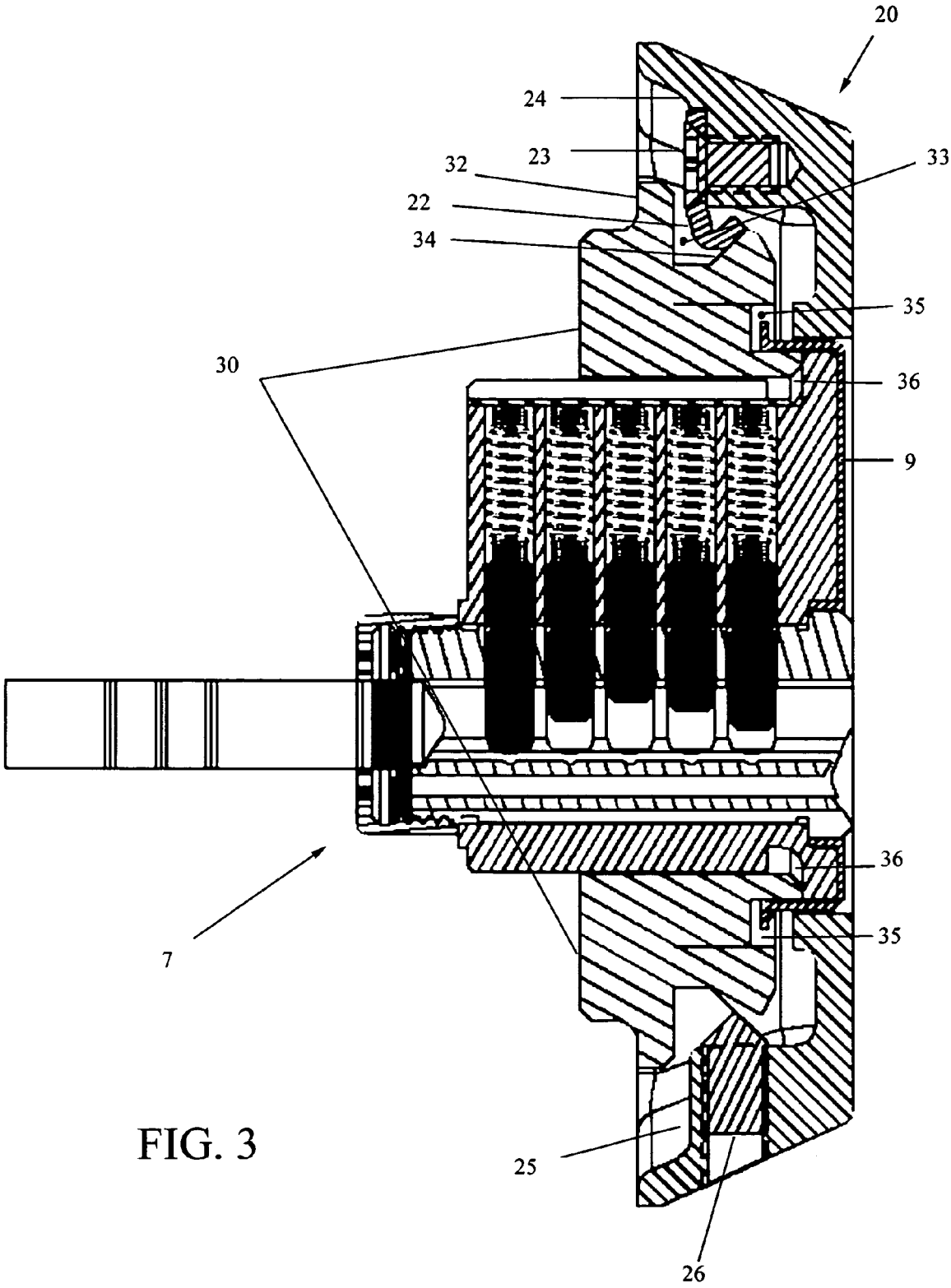
FIG. 3 is a side cross-section of the assembled escutcheon assembly of FIG. 2.

FIG. 3 is a side cross-section of the assembled escutcheon assembly of FIG. 2. The tapered collar 30 is an annular member formed with a particular cross-sectional profile including a central aperture dimensioned to conform to the body of the cylinder 7 (allowing insertion thereover). Preferably, the one end of the central aperture is bounded by a flange 36 for overlying and capturing the cylinder 7 there behind, and the illustrated embodiment further includes a circular recess 35 surrounding the flange 36 for seating the lip of the cylinder face plate 9. The periphery of the tapered collar 30 is formed with the annular flange 32 adjacent groove 33. In the illustrated embodiment the groove 33 sits immediately in advance of flange 32, though this order may be reversed. The groove is preferably approximately 2-5 mm in depth, and the side abutting flange 32 is vertical while the side opposing flange 32 is tapered inward. The taper 34 comprises an approximate 45 degree angled surface sloping down and into the trough of groove 33. This tapered surface 34 serves the purpose of self-entering the clip 22, and as well gradually centering the set screw 26 as it is tightened. When fully tightened, the taper 34 of groove 33 biases the decorative face plate 20 backward against the door. The clip 22 is formed to protrude downwardly into the groove 33 and while other shapes may be suitable the illustrated clip 22 is formed with a bent prong abutting the angled surface 34. This provides a small degree of resiliency. The clip 22 may be entirely formed of stamped metal and is screwed into a threaded hub 24 formed along the inside lower edge of decorative housing 20. The set screw 26 is preferably diametrically opposite the clip 22 and likewise screws into a threaded hub 25 formed along the inside bottom edge of decorative housing 20. The set screw 26 is preferably keyed with a hex key or other tamper-proof key, and has a beveled tip conforming to the 45 degree angle of the groove 33 so as to cooperate and seat itself against the angled surface 34. As with the clip 22, the tapered surface 34 serves the purpose of self-centering the set screw 26. Note that the upper hub 24 comprises an integrally-formed hub with horizontal-entry threaded bore for screw 23, while the lower hub 25 comprises an integrally-formed hub with vertical-entry threaded bore for set screw 26. Typically, clip 22 and screw 23 will be permanently attached in the upper hub 24 and the set screw 26 will be partially inserted into the lower hub 25 pending tightening to secure the decorative housing 20 over the cylinder 7. This way, the decorative face plate 20 may be temporarily positioned against the door with overhead clip 22 seated overtop the lip 32 of tapered collar 30, and then the set screw 26 is tightened into alignment with the groove 33 of tapered collar 30. The set screw 26 enters the groove 33 and the contour of groove 33 forces the decorative face plate 20 rearwardly against the door to ensure a secure flush mount.

Figure 4:
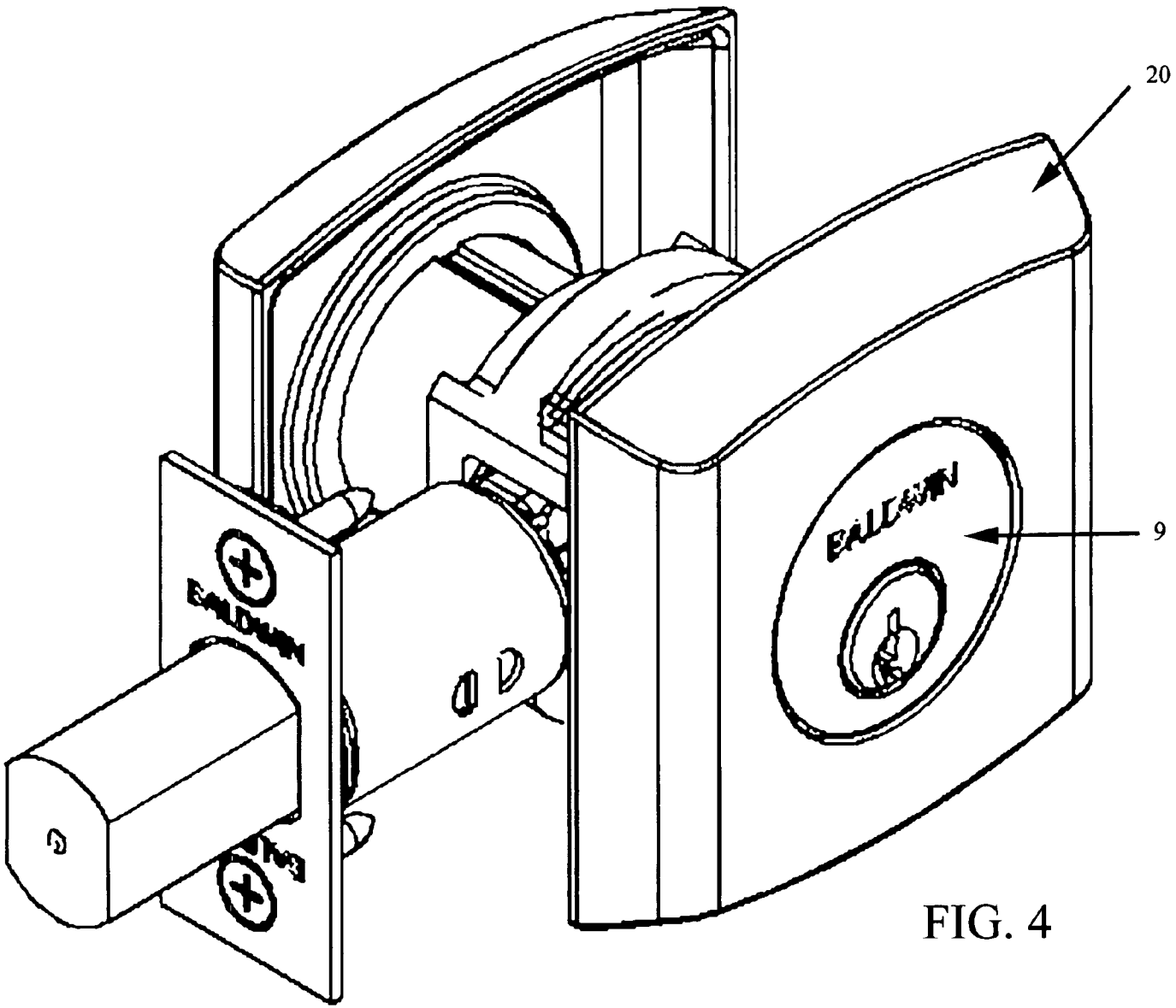
FIG. 4 is a perspective view of the assembled escutcheon assembly of FIGS. 2 and 3.

FIG. 4 is a perspective view of the assembled escutcheon assembly of FIGS. 2 and 3 showing the decorative face plate 20 securely attached flush against the door.

The above-described escutcheon assembly inclusive of tapered collar 30 and decorative face plate 20 (with combined set screw 26 and clip 22) allows the outward appearance of the decorative face plate 20 to assume virtually any shape including square or rectangular, thereby increasing in choosing and then matching inside and outside decorative face plates. The combined set screw 26 and clip 22 provide a leveraged and steadfast attachment of the decorative face plate 20 flush against the door. Moreover, the only outwardly exposed fastener is the hex-keyed set screw 26 which greatly deters tampering.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. An escutcheon assembly for a deadbolt lock on a door, said deadbolt lock including a deadbolt in cooperation with a keyed cylinder having an annular peripheral flange, said escutcheon assembly comprising:

a collar having a central aperture adapted for insertion onto the cylinder abutting said flange, said collar including an annular groove; and a decorative face plate comprising a frame with recessed interior and a central aperture in said frame for exposing a portion of said cylinder, a clip attached to the frame and protruding inward behind said face plate aperture to a distal end for engaging the annular groove in said collar for engagement therewith, and a set screw threaded into the frame and protruding inward behind said face plate aperture, opposite said clip to a distal end for engaging the groove in said collar;

whereby insertion of the face plate clip into the groove of said collar and tightening of the opposed set screw into said groove affixes the decorative face plate over said cylinder.

2. The escutcheon assembly according to claim 1, wherein the groove in said collar is formed with opposing walls, one of said walls having an inwardly angled surface to taper said groove.

3. The escutcheon assembly according to claim 2, wherein the distal end of said clip conforms to the tapered annular groove in said collar for engagement therewith.

4. The escutcheon assembly according to claim 2, wherein the distal end of the set screw in said face plate conforms to the tapered annular groove in said collar for engagement therewith.

5. The escutcheon assembly according to claim 4, wherein the distal end of said set screw centers the set screw in said tapered groove upon tightening of said set screw.

6. The escutcheon assembly according to claim 5, wherein the distal end of said set screw urges said face plate flush against said door when the set screw is tightened into the groove of said collar.

7. The escutcheon assembly according to claim 1, wherein said face plate further comprises a first protruding hub having a threaded bore for insertion of the set screw.

8. The escutcheon assembly according to claim 7, wherein said face plate further comprises a second protruding hub having a threaded bore for screw-attachment of the clip.

9. An escutcheon assembly for covering a lock cylinder mounted on a door, said lock cylinder having an annular flange, the escutcheon assembly comprising:

a collar having a central aperture adapted for insertion onto the lock cylinder on one side of and abutting said flange, said collar including an annular peripheral lip adjacent an annular peripheral groove; and a face plate having a central aperture for exposing a keyslot of said lock cylinder, a clip attached to said face plate and protruding inward toward said collar aperture for engaging the groove of said collar, and a set screw threadably engaged in said face plate and protruding toward said collar aperture to a distal end for engagement in the groove of said collar;

whereby insertion of the face plate clip into the groove of said collar and tightening of the opposed set screw into the groove of said collar affixes the face plate over said lock cylinder.

10. The escutcheon assembly according to claim 9, wherein the annular peripheral groove of said collar is formed with a tapered wall for centering the set screw of the face plate therein and urging said face plate flush against said door when the set screw is tightened into the groove of said collar.

11. The escutcheon assembly according to claim 9, wherein said face plate further comprises a first protruding hub having a threaded bore for insertion of the set screw.

12. The escutcheon assembly according to claim 11, wherein said face plate further comprises a second protruding hub having a threaded bore for screw-attachment of the clip.

13. The escutcheon assembly according to claim 10, wherein said clip is formed with a furled edge conforming to the taper of said groove.

14. A method for attaching a face plate to a lock cylinder formed with a flange, comprising the steps of:

inserting a collar onto said lock cylinder on one side of said flange, said collar having an annular peripheral lip adjacent an annular peripheral groove;

inserting a face plate over said lock cylinder on another side of said flange, said face plate having a clip for engaging the lip of said collar and an opposing set screw for engaging the groove of said collar;

catching the clip of said face plate over the lip of said collar;

tightening the set screw of said face plate into the groove of said collar to secure the face plate over the lock cylinder and to the collar.

15. The method for attaching a face plate to a lock cylinder according to claim 14, wherein the groove of the collar is formed with a tapered side to center the face plate during said tightening step.

* * * * *